United States Patent [19]

Manska

[11] 4,045,027

[45] Aug. 30, 1977

[54] DEVICE FOR INTERCEPTING AND DEFLECTING A MOVING BODY

[75] Inventor: Wayne E. Manska, Santa Ana, Calif.

[73] Assignee: Ronald R. Moody, Yorba Linda, Calif.

[21] Appl. No.: 640,644

[22] Filed: Dec. 15, 1975

[51] Int. Cl.[2] ..... A63B 65/12

[52] U.S. Cl. ..... 273/96 R

[58] Field of Search ..... 273/58 R, 58 A, 58 J, 273/22 D, 228, 230, 95 R, 96 R, 96 C, 67 R

[56] References Cited

U.S. PATENT DOCUMENTS

| | | | |
|---|---|---|---|
| 1,624,822 | 4/1927 | Beldam | 273/58 A |
| 2,025,995 | 12/1935 | Lerch | 273/96 R |
| 2,075,372 | 3/1937 | Taylor | 273/96 R |
| 2,505,090 | 4/1950 | Berry | 273/96 R |
| 3,392,978 | 7/1968 | Wiest | 273/96 C |
| 3,697,074 | 10/1972 | Duncan | 273/58 R |

*Primary Examiner*—William H. Grieb
*Attorney, Agent, or Firm*—Raymond L. Madsen

[57] ABSTRACT

There is disclosed an elongated member having two ends and a surface therebetween over which a body may be directed, the surface containing a center line of symmetry along the length thereof and being progressively curved along the center line with a radius of curvature adjacent one end gradually increasing in magnitude to a larger radius of curvature adjacent the other end such that the curvature adjacent the other end substantially approximates the path of the body in motion which may be intercepted by the elongated member and which curvature progressively increases from the other end to the one end to smoothly deflect and change the direction of the intercepted body from the original path. A pair of rail members is attached to the surface of the elongated member, the rail members flaring progressively outwardly symmetrically about the center line from the one end to the other end to form a substantially wide flat area adjacent the other end bounded by the flared rail members such that a body which may be intercepted by the substantially wide flat area is smoothly directed along the surface between the flared rail members with a minimum number of contacts therewith as the body traverses the length of and is ejected from the elongated member. A preferred embodiment of the moving body which may be used with the elongated member is a spherical member having a spherical core, a spherical interliner surrounding the spherical core and an outer shell surrounding the spherical interliner, the spherical interliner having a low coefficient of elasticity and a minimum mass and the outer shell having a mass substantially equivalent to the mass of the spherical core and having an outer surface with a minimum coefficient of friction with respect to the surface of the elongated member whereby the spherical member may move freely over the surface of the elongated member and substantially will not bounce therefrom when intercepted thereby.

12 Claims, 15 Drawing Figures

33
27
35

33
27
35

33
29
35

33
31
34
35

31
34

5
4
21
6
35
5
4
6
3
3
7
7
23
25

23
17
27
21
29
19
31
34
25
35
33

DEVICE FOR INTERCEPTING AND DEFLECTING A MOVING BODY

The present invention relates to devices for intercepting and deflecting bodies in motion and more particularly to hand-held receiving and throwing devices for maintaining a ball or spherical object in continuous flight or motion and to game devices that develop player coordination, dexterity and skill.

In the field of devices suited to keep a spherical body or ball in play by one or more players through the exercise of more or less dexterity, it has been the general practice to employ a game apparatus for tossing and catching a ball comprising a substantially semi-circular guide having a ball-receiving funnel on one end of two upturned ends thereof as described in U.S. Pat. No. 2,510,403, issued to E. J. Krupp, entitled, "A Ball Juggling Toy" and U.S. Pat. No. 3,392,978, issued to W. H. Wiest, Jr., entitled, "Ball Projecting and Catching Device," such that a ball in ballistic flight may be caught in the funnel and delivered from the funnel to the guide under the momentum acquired in flight to said funnel and may be thrown or ejected from the other end of the guide with a minimum of manual effort. Although such devices have served the purpose, they have not proved entirely satisfactory under all conditions of service for the reason that considerable difficulty has been experienced in moving the ball through the funnel of the receiving end due to the inherent tendency of the ball to ricochet and spiral with increasing frequency from one side of the funnel to the other as it traverses from the wide to narrow region of the funnel, thereby slowing the motion and velocity of the ball as it progresses through the ball-receiving and ejecting apparatus.

Those concerned with the development of the ball-receiving and throwing devices have long recognized the need for a receiving or catching shape and configuration which smoothly and efficiently receives, delivers and directs a ball along the surface thereof with a minimum of bounding and rebounding from the guiding surfaces thereof. The present invention fulfills this need.

Some game devices have been developed which do not use a funnel to catch and receive a ball, such as described in German Pat. No. 847,561, issued to Hans Meyer. This patent is directed to a sports gadget made out of a bent gutter having a straight section which is used for catching a ball and which section employs a wide, flat area adjacent one end to receive the ball. The ball is directed along the gutter which substantially has parallel sides. Such a device has not served the purpose, since it has not proved entirely satisfactory under all conditions for the reason that considerable difficulty has been experienced in directing the ball from the wide, flat area and delivering it into the straight gutter section. This problem is overcome by the present invention.

One of the most critical problems confronting designers of ball-receiving and throwing apparatus has been to provide a curved shape adapted to receiving a ball in ballistic flight and which smoothly and progressively changes the direction of the ball. This problem is overcome by the present invention.

The general purpose of this invention is to provide a ball-receiving and throwing game apparatus which embraces all the advantages of similarly employed game apparatus and possesses none of the aforedescribed disadvantages. To attain this, the present invention contemplates a unique curved surface in combination with flared sides or rails therealong and a spherical body or ball for receiving and throwing therewith whereby spiraling, bouncing and loss of kinetic energy of the ball are substantially avoided.

An object of the present invention is the provision of a ball-receiving and throwing device having a curved surface thereon which approximates the path of a body in motion and smoothly and progressively curves to deflect the body from the original path.

Another object of the present invention is the provision of a curved ball-receiving and throwing device which smoothly intercepts a ball in flight and smoothly and efficiently centers the ball on a surface of the device so that it may be accurately thrown or ejected therefrom.

Yet another object is to provide a ball throwing and receiving device having a curved surface which resembles the shape of a cantilever beam of which the free end is deflected through an angle of substantially 90° with respect to the fixed end, which curve smoothly intercepts a ball in ballistic flight and progressively curves the motion of the ball from the original path of flight.

A further object of the invention is the provision of a ball-receiving and throwing device having a curved surface thereon with a wide, flat area at one end bounded by sides or rails which smoothly narrow from the width of the wide, flat area to a width slightly greater than the diameter of a ball whereby the ball may be smoothly directed therebetween with a minimum of chatter and bounce.

A still further object is to provide a ball-receiving and throwing device which can receive or eject a ball from either end thereof.

Still another object of the present invention is a provision of a ball receiving and throwing device which can scoop a stationary ball from a surface upon which it rests.

Still another object of the invention is to provide a ball-receiving and throwing device having a center of gravity which enhances the greatest dexterity and skill of a player.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 13:
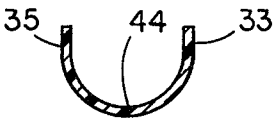
Figure 10:
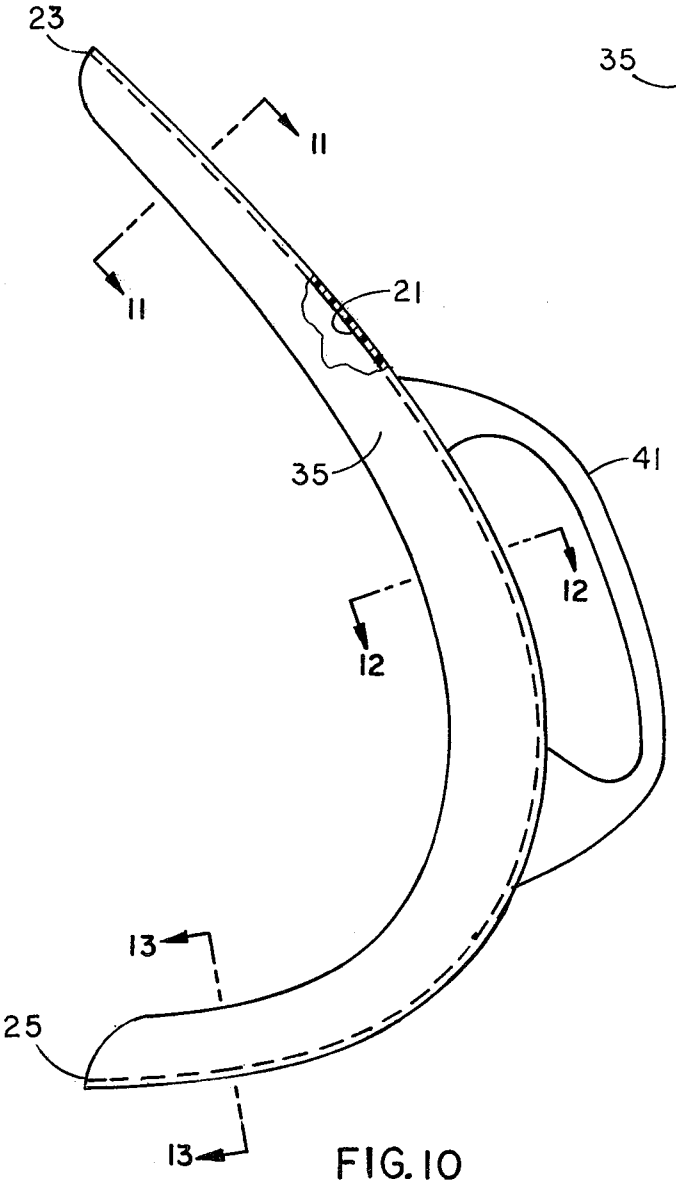
FIG. 10 shows a side elevation of the apparatus illustrated in FIG. 9.
Figure 9:
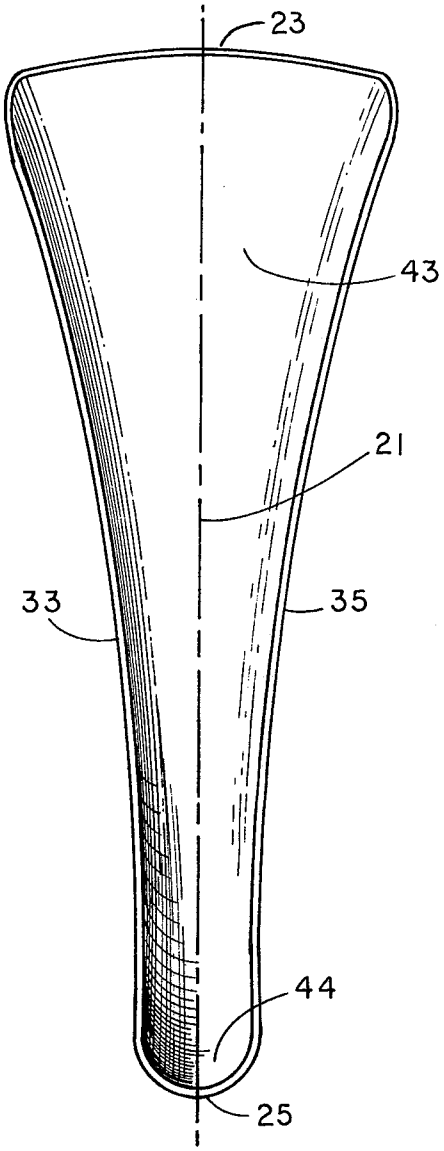
FIG. 9 illustrates a front elevation of an alternate embodiment of the invention.
Figure 15:
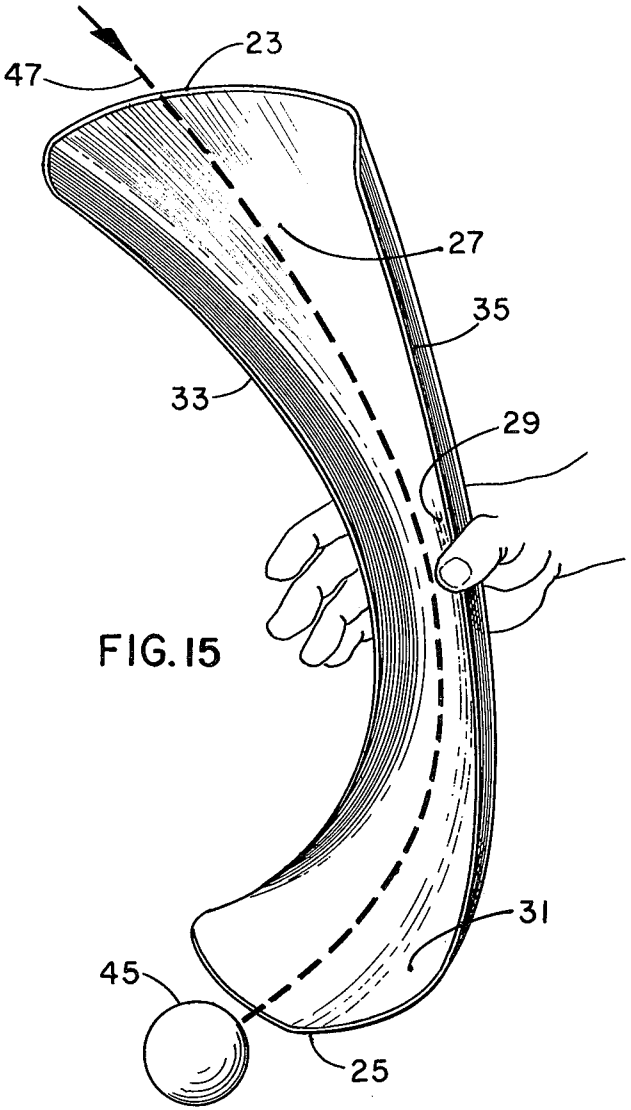
Figure 14:
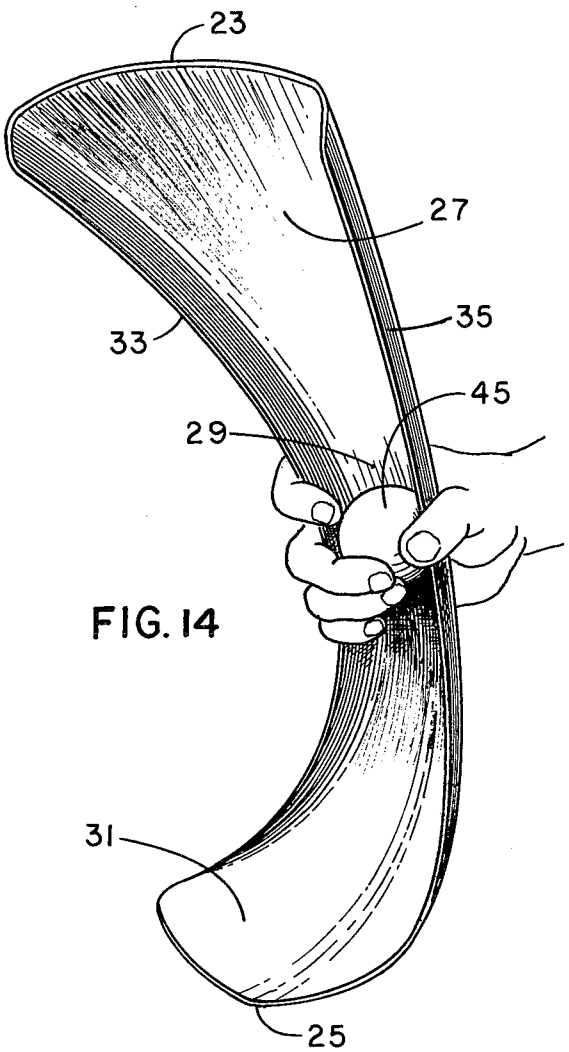

FIG. 13 shows a section of the device of FIGS. 9 and 10, taken on the line 13—13 of FIG. 10, looking in the direction of the arrows; and FIGS. 14 and 15 illustrate pictorial views of the device held in the hand of an operator in two positions of operation.

Figures 1, 2, 3, 4, 5, 6, 7:
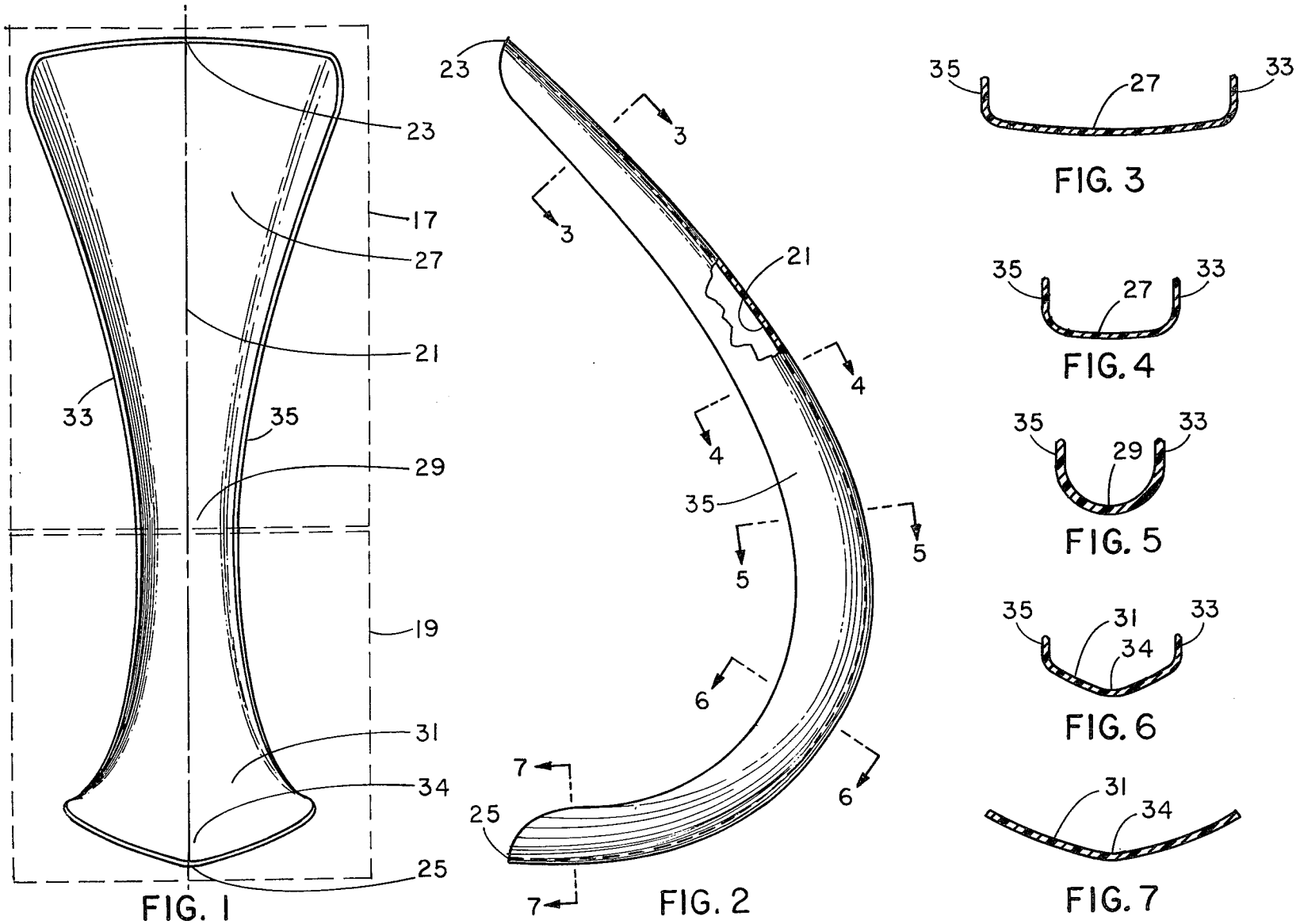
FIG. 1 shows a front elevation, of a preferred embodiment of the invention.
FIG. 2 illustrates a side elevation of the apparatus shown in FIG. 1.
FIG. 3 shows a section of the device taken on the lines 3—3 of FIG. 2, looking in the direction of the arrows.
FIG. 4 shows a section of the device taken on lines 4—4 of FIG. 2, looking in the direction of the arrows.
FIG. 5 shows a section of the device taken on lines 5—5 of FIG. 2, looking in the direction of the arrows.
FIG. 6 shows a section of the device taken on lines 6—6 of FIG. 2, looking in the direction of the arrows.
FIG. 7 shows a section of the device taken on lines 7—7 of FIG. 2, looking in the direction of the arrows.

Referring now to the drawings, wherein like reference characters designate like or corresponding parts throughout the several views, there is shown in FIG. 1 (which illustrates a preferred embodiment), an elongated member having a receiving section or end indicated by that portion within the dashed lines designated as 17 and an ejecting or throwing section or end within the dashed lines designated as 19, the elongated member having a center line of symmetry 21 extending along the surface thereof between ends 23 and 25. A wide, substantially flat surface 27 is located adjacent end 23 and gradually narrows to a curved surface 29, which in turn widens to a broad V shaped surface 31 adjacent end 25. Rails or sides 33 and 35 extend the length of the elongated member and blend into surface 31 adjacent end 25.

There is shown in FIG. 2, which is a side elevation of the device of FIG. 1, the curvature of the elongated device and specifically that of center line 21, between ends 23 and 25, the radius of curvature adjacent end 23 being larger in magnitude and gradually becoming of less magnitude progressively toward end 25. Side 35 substantially extends from end 23 to end 25. The height of side 35 is larger than the radius of a spherical body which may traverse the elongated member between ends 23 and 25.

FIGS. 3, 4, 5, 6 and 7 illustrate the cross sections of the device of FIGS. 1 and 2 at various locations therealong.

FIG. 3 illustrates the cross section of receiving section 17 adjacent end 23.

FIG. 4 shows another cross section of receiving station 17 narrowed into a substantially U cross section.

FIG. 5 illustrates a cross section of the device illustrated in FIGS. 1 and 2 at the juncture between the receiving end 17 and throwing or ejecting end 19, showing curved area 29 smoothly blending with sides 35 and 33.

FIG. 6 shows a portion of surface 31 nearest the juncture of receiving end 17 and ejection end 19, having a substantially broad V shape with an apex 34 having a radius of curvature approximating or slightly larger than the radius of a spherical body which may traverse thereover, surface 31 being bounded by sides 33 and 35.

FIG. 7 illustrates the cross section of the device adjacent end 25 showing a broad V cross section with the radius of curvature at the apex approximating or being slightly larger than the radius of a spherical body which may traverse thereover.

It is also important to note throughout FIGS. 3–6 that the intersection of sides or rail members 33 and 35 with surfaces 27 and 31 is a smooth transition region having a radius of curvature smaller than the radius of a spherical body which may traverse thereover.

Figure 8:
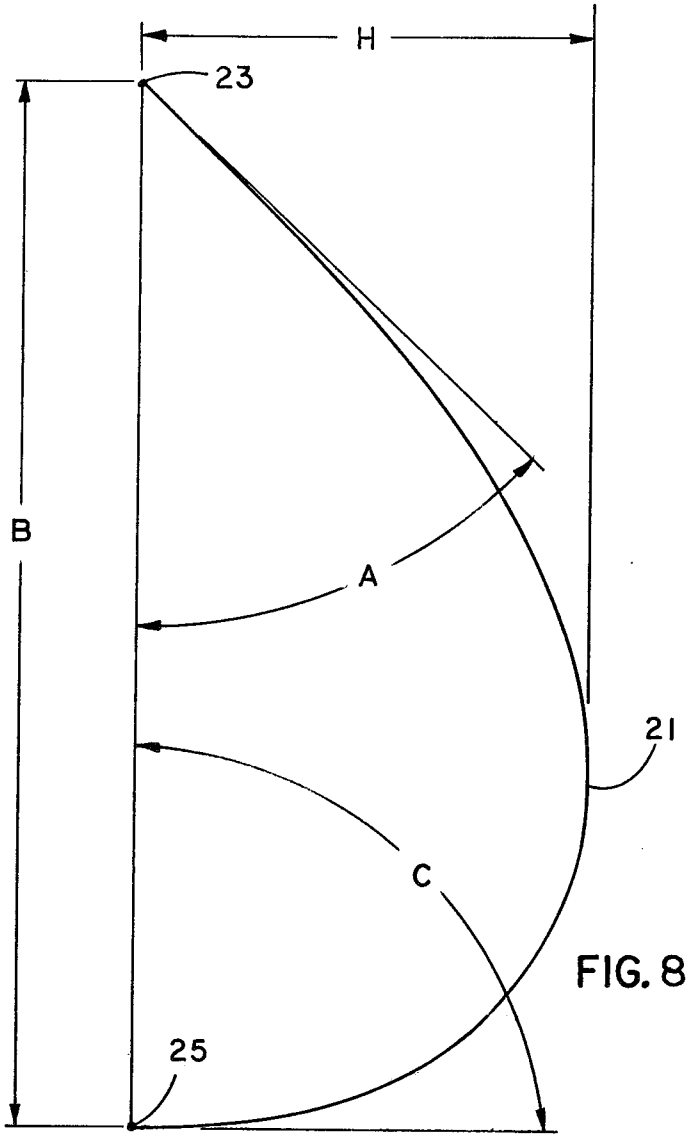
FIG. 8 illustrates the base, height, and relative angles of the end points of the curve of the device illustrated in FIGS. 1 and 2.

There is illustrated in FIG. 8 the shape of the curve of center line 21 of the ball receiving and throwing device, the straight line distance between ends 23 and 25 thereof being designated as the base B and the perpendicular distance between the base and the most distant part of the curve of center line 21 being designated as height H. The curve is substantially that formed by bending or deflecting the free end of a cantilever beam through an angle less than 130 degrees with respect to the fixed end thereof, the fixed end being equivalent to end 25 and the free end being equivalent to end 23 of the elongated member. The angle between the base B and a tangent to the curve adjacent end 25 is designated as angle C, and the angle between base B and a tangent to the curve adjacent end 23 is designated as angle A.

FIG. 9 shows an alternate elongated member or ball catching and throwing device similar to that shown in FIG. 1, except that sides or rail members 33 and 35 are substantially parallel adjacent end 25 and gradually flare outwardly toward end 23, and a curved narrow surface 44 is located adjacent end 25 with a flat wide surface 43 adjacent end 23.

FIG. 10 is substantially identical to the side elevation illustrated in FIG. 2 and is the side elevation of the alternate device illustrated in FIG. 9. The curvature of center line 21 is substantially identical with the curvature illustrated in FIG. 2. A handle 41 is located centrally on the exterior surface of the device to aid the operator in manipulating the device.

Figure 11:
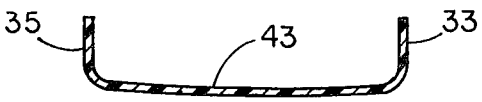
FIG. 11 shows a section of the apparatus illustrated in FIGS. 9 and 10, taken on the line 11—11 of FIG. 10, looking in the direction of the arrows.

FIG. 11 shows a cross section of the device illustrated in FIG. 10, taken at line 11—11, revealing substantially flat surface 43 between sides 33 and 35 substantially similar to surface 27 illustrated in FIG. 3.

Figure 12:
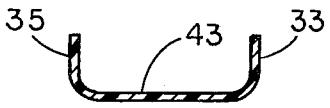
FIG. 12 shows a section of the device of FIGS. 9 and 10, taken on the line 12—12 of FIG. 10, looking in the direction of the arrows.

Similarly, FIG. 12 shows a cross section of the device illustrated in FIG. 10, taken at line 12—12, showing surface 43 narrowing between sides 33 and 35.

FIG. 13 shows another cross section of the device shown in FIG. 12, taken at line 13—13, illustrating surface 44 smoothly blending with sides 33 and 35, similar to surface 29 of FIG. 5.

FIG. 14 illustrates a pictorial view of the device illustrated in FIGS. 1 and 2, showing spherical body or ball 45 captured and held by the hand of an operator over surface 29, which is the preferred starting position to start ball 45 in motion.

FIG. 15 illustrates a trajectory 47 of ball 45 as it is intersected by surface 27 and traverses the length of the elongated ball-receiving and throwing member from end 23 to end 25, while grasped by the hand of an operator.

Operation of the device can best be understood by first analyzing the physical features of the elongated ball-receiving and throwing member.

Turning to FIGS. 1 and 2, the device is bi-laterally symmetrical about centerline of symmetry 21, which traverses the inside surface from end 23 to end 25. Center line 21 is a single flexure curvilinear curve as shown in FIG. 8, having a base B to height H ratio greater than 1.5 and typically of a magnitude greater than 2.0 and less than 3.5. The curvature of center line 21 represented by the deflection of a cantilever beam best approximates the trajectory of a ball in ballistic motion adjacent end 23 where the radius of curvature of the center line 21 is large. The radius of curvature of center line 21 gradually decreases in magnitude from end 23 to end 25 to provide a smooth and progressive deflection of a ball in ballistic flight from the intercepted trajectory at end 23 through an angle of 90° to 150° (i.e., the sum of angle A plus angle C of FIG. 8) back toward the direction from which the ball or spherical object was projected. This general shape or curvature was found through much experimentation and trial and error as being an ideal or desirable curve to obtain the greatest and most effective ball handling capability for a player utilizing the device.

Rail members or sides 33 and 35 extending from the narrowest region at surface 29 and flaring therefrom outwardly about center line 21 to end 23, provide a wide surface area 27 adjacent end 23 to receive and direct a ball or spherical object or body in ballistic flight. If the ball is not received directly along center line 21, it may contact side 33 or 35 and be deflected therefrom to the opposite side. However, the gradual flare or curve of the sides prevents the inherent increase of bouncing of the ball which occurs between straight sides of a funnel as the ball progresses therebetween. Therefore, a minimal amount of kinetic energy is removed from the ball. By having area 27 nearly flat in cross section adjacent end 23, the ball is prevented from oscillating back and forth between sides 33 and 35 as it progresses along surface 27. As the ball approaches the narrowest portion of the device, it becomes centered between sides 33 and 35. It is desirable to have the surface become curved as displayed by surface 29 to maintain the ball centered on the device. As the ball leaves curved surface 29, it then passes over surface 31. To further maintain the ball centered, surface 31 is V-shaped having a radius of curvature at apex 34 approximately equal to or slightly larger than the radius of the ball to keep the ball centered therein. This provides for an accurate and reliable ejection of the ball in a desired direction from the device. By having surface 31 widen out at end 25 and ends 33 and 35 to disappear and blend thereinto, end 25 has a shovel-like appearance and may be further utilized to scoop a ball from a surface onto the device. Furthermore, surface 31 may be used as an alternate receiving or intercepting area to catch balls or bodies in flight.

In operation, the device of FIGS. 1 and 2 is illustrated in FIGS. 14 and 15 where ball 45 is grasped between the fingers and held against surface 29 until ready for play. Upon releasing the ball as illustrated in FIG. 15 and slightly rotating and moving the device forward and upward, the ball can be propelled from end 25 in a desired or given direction. Normally, the ball will be received by the operator on or along surface 27 with sides 33 and 35 confining the motion of the ball to surface 27 and centering the ball along center line 21 as it approaches and passes over curved surface 29. Therefore, a smooth interception or reception of the ball is provided by the shape of the curve of center line 21 and a smooth and gradual centering of the ball toward center line 21 is provided by the flared or tapered rail members or sides 33 and 35. These two features heretofore have not been utilized in prior art devices of this nature.

The alternate device illustrated in FIGS. 9 and 10 is utilized for catching and throwing only and not for scooping a ball from a surface such as may be performed by the device of FIGS. 1 and 2. Furthermore, the operator may grasp handle 41 and more easily manipulate the receiving and throwing device than by grasping the central region as illustrated in FIGS. 14 and 15. It is to be noted that handle 41 may be utilized with the device illustrated in FIGS. 1 and 2 and omitted from the device illustrated in FIGS. 9 and 10.

The catching and throwing devices illustrated in FIGS. 1 and 2 and FIGS. 9 and 10 can be made from molded plastic having a wall thickness sufficient to provide the desired structural strength. The construction is further designed such that the center of gravity of the device is located adjacent the narrowest region thereof or the region designed to be held by the hand of the operator. In FIG. 10, this would be the region to which the handle 41 is attached. By having the center of gravity of the device located substantially adjacent the palm of the hand of the operator, greater dexterity and speed in utilizing the device by the operator can be achieved, heretofore not possible with prior art devices.

One of the problems in catching and throwing a ball with such a device as illustrated in FIGS. 1, 2, 9 and 10 is that the plastic construction tends to cause a ball to bounce from the surface thereof and to make it difficult to catch and throw an ordinary ball. It was found that a ball having a specific gravity less than 0.7 performs substantially well and that a ball which rebounds less than 30% from a rigid surface after being dropped from a distance of 36 inches performs exceptionally well with the ball-receiving and throwing device illustrated and described herein in FIGS. 1 and 2.

It was also found that the length of receiving or intercepting Section 17 should be approximately at least as great as one-third the total curved length of the center line.

It now should be apparent that the present invention provides a mechanical arrangement which may be employed in conjunction with an elongated ball-receiving and throwing member for providing a smooth and efficient reception of spherical bodies or balls in ballistic motion and deflecting these balls from the original paths thereof and further provides a spherical body constructed and arranged to be utilized with such ball-receiving and throwing devices.

Although particular components, etc., have been discussed in connection with a specific embodiment of a ball-receiving and throwing device constructed in accordance with the teachings of the present invention, others may be utilized.

Furthermore, it will be understood that although an exemplary embodiment of the present invention is disclosed and discussed, other applications and mechanical arrangements are possible and that the embodiments disclosed may be subjected to various changes, modifications and substitutions without necessarily departing from the spirit of the invention.

What is claimed is:

1. A device for intercepting and deflecting a body in motion, comprising:

an elongated member having two ends and a surface therebetween over which a body may be directed, said surface containing a center line of symmetry along the length thereof and being progressively curved along said center line from a radius of curvature adjacent said one end to a larger radius of curvature adjacent said other end such that the curvature of said elongated member adjacent said other end substantially approximates the path of a body in motion which may be intercepted by said other end and progressively increases from said other end to said one end to smoothly deflect and change the direction of the intercepted body from the original path; and a pair of rail members attached to said surface of said elongated member, said pair of rail members being substantially parallel adjacent said one end and spaced apart by a distance greater than the diameter of the body which may traverse therebetween, said rail members progressively flaring outwardly from said one end to said other end to form therebetween a substantially wide flat area adjacent said other end such that a body which may be intercepted by said substantially wide flat area is deflected smoothly along said surface between said pair of rail members with a minimum number of contacts with said pair of rail members as the body traverses the length of said surface of said elongated member.

2. The devices described in claim 1 wherein the curve of said elongated member along said center line is substantially similar to the curve of a cantilever beam of which the free end is deflected through an angle less than 130 degrees measured with respect to the fixed end and from the undeflected position of the cantilever beam.

3. The device described in claim 2 wherein the straight line distance between the end points of said curve of said elongated member corresponding to the distance between the fixed and free ends of said cantilever beam is designated as the base of said curve and the perpendicular distance between the base and the most distant point of the arch of said curve is designated the height of said curve and wherein the ratio of the base to the height of said curve of said elongated member has a magnitude greater than 1.5.

4. The device described in claim 1 wherein the body which may be intercepted and deflected is spherical in shape and wherein the cross section of said surface normal to said center line is circular at said one end, having a radius of curvature greater than the diameter of a spherical member which may be directed thereover, said surface smoothly and gradually transforming from said circular cross section at said one end to a flat cross section at said other end.

5. The device described in claim 1 further including a handle attached to said elongated member at said region substantially adjacent said center of gravity and oppositely disposed from said surface between said rail members.

6. A device for intercepting and deflecting a moving body member, comprising:

an elongated member having two ends and a surface therebetween over which a moving body member may be directed, said surface containing a center line of symmetry along the length thereof and being curved along said center line with a radius of curvature adjacent one end gradually increasing in magnitude to a larger radius of curvature adjacent the other end, the curvature adjacent said other end approximating the path of the moving body member which may be intercepted by said elongated member and which curvature progressively increases from said other end to said one end to smoothly deflect and change the direction of the intercepted moving body member from the original path thereof; and two rail members attached to said surface and disposed symmetrically about said center line, said rail members being substantially parallel at a point located between said one end and said other thereof and being separated by a distance greater than the diameter of the moving body member which may be directed therebetween, said rail members smoothly and gradually curving and flaring apart progressively toward each end, said surface located between said rail members at said other end being constructed and arranged to intercept the moving body member and confine the body member between said flared rail members gradually centering the body member on said surface with a minimum number of contacts with said rail members, the portion of said surface between said rail members at said one end being constructed and arranged to scoop the body member from a surface upon which it is located and to eject therefrom the body member traversing said surface from said other end to said one end thereof, said surface between said rail members at said one end being an alternate surface for receiving the body member in motion.

7. The device described in claim 6 wherein the body member is a spherical body and wherein the cross section normal to said center line of said surface adjacent said point where said rail members are substantially parallel is substantially circular having a radius of curvature greater than the spherical body which may be directed therethrough, said cross section of said surface smoothly and progressively transforming from a substantially circular cross section at said point where said rail members are parallel to a substantially flat section adjacent said other end of said surface, said cross section of said surface smoothly and progressively transforming from said point where said rail members are parallel to a substantially V shaped section adjacent said one end of said surface, the apex of said substantially V-shaped section being substantially circular in cross section and having a radius of curvature approximating that of the spherical body which may traverse said surface from said other end to said one end whereby the spherical body tends to travel along the apex of said V shaped section along said center line.

8. The device described in claim 6 wherein the curve of said elongated member along said center line is substantially similar to the curve of a cantilever beam of which the free end thereof is deflected through an angle less than 130° measured with respect to the fixed end thereof from the undeflected position of the cantilever beam.

9. The device described in claim 6 wherein the straight line distance between the end points of said center line of said elongated member corresponding to the distance between the fixed and free ends of the deflected cantilever beam is designated as the base of the curve of said center line and the perpendicular distance between the base and the most distant point of the arch of said curve of said center line being designated as the height of said curve and wherein the ratio of said base to said height has a magnitude greater than 1.5.

10. The device described in claim 9 wherein said ratio of said base to said height has a magnitude greater than 2.0 and less than 3.5.

11. The device described in claim 6 wherein the center of gravity of said elongated member is located substantially adjacent said point where said rail members are parallel and wherein the region of said elongated member adjacent said center of gravity is constructed and arranged to be held in the hand of a person operating the device.

12. The device described in claim 6 wherein said rail members are walls integrally formed with said surface having a height greater than the radius of a spherical member which may be intercepted by said elongated member and which may traverse said surface.

* * * * *